United States Patent [19]

Wiesboeck

[11] 4,175,394

[45] Nov. 27, 1979

[54] PROCESS AND APPARATUS FOR PRODUCING AND USING COLD AMMONIA

[75] Inventor: Robert A. Wiesboeck, Stone Mountain, Ga.

[73] Assignee: United States Steel Corporation, Pittsburgh, Pa.

[21] Appl. No.: 911,648

[22] Filed: Jun. 1, 1978

[51] Int. Cl.[2] ..... F17C 7/02

[52] U.S. Cl. ..... 62/51; 55/189; 111/7; 159/6 R

[58] Field of Search ..... 62/51; 111/7; 159/6 R; 55/189, 191

[56] References Cited

U.S. PATENT DOCUMENTS

| | | | |
|---|---|---|---|
| 3,548,569 | 12/1970 | Jepsen et al. | 55/242 |
| 3,913,340 | 10/1975 | Hurley | 62/45 |
| 3,978,681 | 9/1976 | Kjelgaard et al. | 62/51 |
| 4,069,029 | 1/1978 | Hudson | 62/51 |

FOREIGN PATENT DOCUMENTS

| | | |
|---|---|---|
| 841410 | 5/1972 | Canada . |
| 1227128 | 4/1971 | United Kingdom . |
| 1233347 | 5/1971 | United Kingdom . |
| 1261906 | 1/1972 | United Kingdom . |
| 1364067 | 8/1974 | United Kingdom . |

OTHER PUBLICATIONS

Schutte And Koerting Co. Bulletin 9P, 1954 Apr., *Tangential Steam Separator.*

*Primary Examiner*—Ronald C. Capossela
*Attorney, Agent, or Firm*—W. Gary Goodson

[57] ABSTRACT

Cold ammonia, preferably cold liquid anhydrous ammonia preferably at substantially ambient or atmospheric pressure, is applied (1) to the soil as a fertilizer or (2) to feed grains, forages and anaerobically fermentable plant material to supply thereto and provide therein non-protein nitrogen (NPN). The cold ammonia is obtained by (1) introducing a stream of ambient temperature, pressurized liquid ammonia at a velocity of at least about 5000 feet per minute into an expansion chamber, the expansion chamber comprising a substantially vertically elongated barrier means located substantially in the center of the horizontal planes of the expansion chamber and, in the path of the expansion cone of the inlet stream, which barrier means assists in imparting a spinning motion to the inlet stream and allows some liquid ammonia to flow down the barrier means and thereby improves the separation of the liquid and gaseous ammonia, (2) imparting a high velocity spinning motion to the liquid ammonia entering the chamber such that rapid flow is produced around the interior of the chamber to thereby provide rapid separation of the liquid and gaseous ammonia formed in the chamber.

42 Claims, 7 Drawing Figures

PROCESS AND APPARATUS FOR PRODUCING AND USING COLD AMMONIA

FIELD OF THE INVENTION

Figure 1:
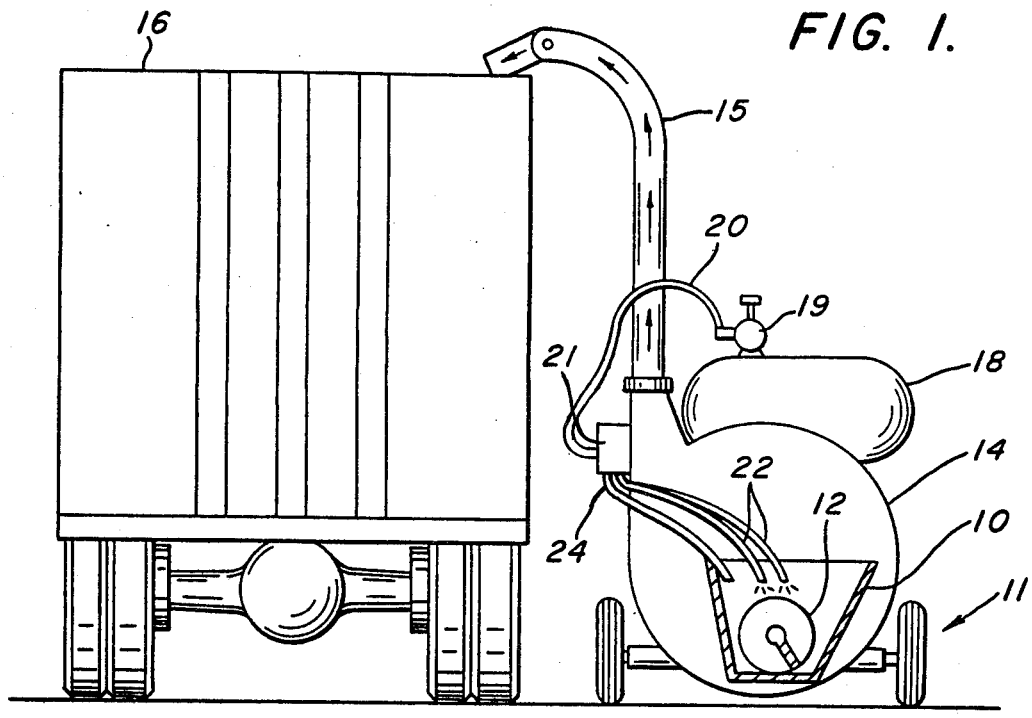

This invention relates to the utilization of ammonia. One aspect of this invention relates to the utilization of ammonia as a soil fertilizer. Another aspect of this invention relates to the utilization of ammonia in the treatment of feed grains and forage such as in the preparation of silage to provide therein non-protein nitrogen (NPN). Still another aspect of this invention involves the utilization of ammonia in the treatment of food and feed products, including small grains, corn, hay and the like prior to storage to prevent spoilage, such as spoilage due to fungi.

BACKGROUND OF THE INVENTION

Ammonia is applied to soils as a nitrogen fertilizer and to silage as a non-protein nitrogen source. The ammonia used for these purposes is usually stored in compressed form as a liquid at ambient temperature. Because of its vapor pressure, liquid ammonia at ambient storage is generally under a pressure of about 80 to about 200 psig. Conventionally, ammonia is applied to soils by injection through a series of so-called knives, which are pulled through the soil at a depth of about 6 to 15 inches. The ammonia is supplied from a pressure tank through a metering valve and discharged behind the tip of each knife. The pressure of the ammonia is released partly at the metering valve and partly at the knife end. Since the expansion of compressed ammonia occurs instantaneously, an intimate mixture of vapor and droplets form at the point of expansion.

Ammonia is also used to treat forage in the preparation of silage to provide a non-protein nitrogen source suitable for animal consumption. In this case, ammonia is applied directly to freshly cut forage material such as corn or sorghum.

Ammonia in the form of an aqueous solution has been applied to anaerobically fermentable plant material for silage production to provide feed for ruminant animals, the applied ammonia being converted to nitrogen compounds providing non-protein nitrogen (NPN) which is consumable by ruminant animals, as taught, for example, in U.S. Pat. No. 3,753,723, incorporated herein by reference. In field applications such as in soil fertilization and trench silage production, this method has serious disadvantages due to the necessity of carrying a separate water supply along with the ammonia and other field equipment. A more economical and simpler method of application of ammonia to soils and silage is described in U.S. Pat. Nos. 3,978,681 and 4,069,029, each incorporated herein by reference, which disclose a method in which the pressure of the compressed, liquid ammonia is released prior to application in an expansion chamber which separates the gas from the liquid. Both phases are then applied to the soil or silage separately, thereby allowing a more uniform flow and a safer non-pressure application. An additional advantage of this method is that it permits, in the case of soils, the application of ammonia with a conventional disc harrow or cultivator instead of a special knife applicator. Since the cold liquid and gaseous ammonia produced by this process does not flash or sputter at substantially atmospheric pressure as easily as when pressurized liquid ammonia is applied to the soil directly in the prior art process, the cold ammonia can be applied to the top of the soil or at much shallower depths in combination with the field cultivator so that the cold ammonia thus applied is covered immediately by the soil turned over by the field cultivator. Thus a separate trip over the field to apply ammonia is eliminated. This results in fuel, labor, and machinery wear savings. Also eliminated is the need for knife maintenance and replacement costs.

The expansion chamber of U.S. Pat. No. 3,978,681 is designed to utilize gravity for the separation of the gaseous and liquid ammonia. In essence, the ammonia is introduced in the center of the chamber through an inlet pipe from which the liquid phase falls to the bottom and the gas rises to the top. Each phase is discharged through pipes in the bottom and the top, respectively. To improve the separation, each discharge exit is shielded with a baffle plate to avoid entrainment of liquid with the gas phase, and vice versa.

The liquid phase is then passed through a distribution device which divides the flow into several streams of equal portions to be applied to the soil through individual hoses. Gaseous ammonia is similarly applied through another set of hoses.

The shortcoming of this baffled device is mainly in the rather inefficient phase separation in the expansion chamber. In applications of ammonia to soils, relatively large quantities of ammonia have to be expanded and separated into the liquid and gas phases. Rates of up to 8,000 pounds per hour are not uncommon. To separate ammonia at such high rates requires a very large expansion chamber. Thus, a device which would avoid the need for a large and heavy piece of equipment is highly desirable and useful. Since the expansion chamber may be moved from one piece of field equipment to another by the farmer or other end user, it is very important that the size and weight of the expansion chamber be such that it can readily be moved by hand by a few and preferably one individual.

The device of U.S. Pat. No. 4,069,029 overcame some of the aforementioned inefficient separation problems by a process wherein the liquid and gaseous ammonia of reduced pressure from an inlet conduit from a pressure tank is added tangentially into a cylindrical chamber at velocities exceeding 5,000 feet per minute. This creates a fast circular motion in the chamber which forces the liquid to the wall where it descends in a spiral pattern to the bottom outlet. The gas, being lighter than the liquid, is forced to the center and upward to the outlet at the top. To increase the capacity, a second stage containing a mist eliminator may be added.

However, even with the improved efficiency of the equipment of this latter patent, the equipment is often of sufficiently large size and of significant complexity to build that it presents considerable cost to manufacture. This is particularly true due to the need for a separate mist eliminator on this equipment. When the size of this prior art equipment is significantly reduced, the ammonia capacity is so severely reduced that a large field cultivator may require many different expansion chambers attached across the width of the cultivator in order to apply the ammonia at the desired rate. Additionally, the gas outlet tube coming from the top of the chamber often has problems with crimping when flexible tubing is utilized resulting in excessive wear or damage and uneven distribution in the gaseous ammonia lines. To avoid this crimping problem, extra cost is involved in changing the direction of the gaseous ammonia from its initial upward direction to a downward direction so that it can be applied to the soil, to forage, etc.

BRIEF DESCRIPTION OF THE INVENTION AND FIGURES

This invention relates to a method and apparatus for carrying out the expansion of a pressurized stream of ambient-temperature liquid ammonia to produce separate streams of cold liquid and gaseous ammonia at reduced pressure, and preferably at substantially ambient or atmospheric pressure. The method includes the steps of (1) introducing at a velocity of at least about 5000 feet per minute a stream of ambient-temperature, partially decompressed liquid ammonia into an expansion chamber, the expansion chamber comprising a substantially vertically elongated barrier means located substantially in the center of the horizontal planes of the expansion chamber and, in the path of the expansion cone of the inlet stream which barrier means assists in imparting a spinning motion to the inlet stream and allows some liquid ammonia to flow down the barrier means and thereby improves the separation of the liquid and gaseous ammonia, (2) imparting a high velocity spinning motion to the ammonia entering the chamber such that a rapid flow is produced around the interior of the chamber to thereby provide rapid separation of the liquid and gaseous ammonia, and wherein the expansion chamber is provided with a first outlet useful for the removal of gaseous ammonia from the chamber and which first outlet is located above the path of centrifugal flow and second outlet useful for the removal of cold liquid ammonia therefrom, the outlets being provided at opposite ends of the expansion chamber, (3) directing the flow of the cold reduced pressure liquid ammonia within the expansion chamber to the second outlet to effect separation between cold liquid ammonia and cold gaseous ammonia within the expansion chamber, and (4) withdrawing through the first outlet a stream of cold gaseous ammonia at substantially reduced pressure and a stream of cold liquid ammonia at substantially reduced pressure from the second outlet.

The expression "expansion cone of the inlet stream" refers to the conical stream of ammonia formed by the expanding ammonia stream in the expansion chamber after the stream leaves the inlet conduit. Preferably, this expansion cone is composed of a substantially unidirectional, although expanding, stream of gaseous and liquid ammonia. This is accomplished by controlling the size of the inlet conduit, the flow rate and other like factors to allow sufficient expansion of the pressurized ammonia to take place in the inlet conduit that explosive expansion is avoided when the ammonia stream first enters the expansion chamber. The terms "partially decompressed" and "reduced pressure" refer to the ammonia stream where some expansion of the pressurized liquid ammonia from the ammonia storage tank has taken place, but not complete decompression down to atmospheric pressure.

Utilization of this invention results in improved efficiency of the process of producing cold ammonia, separating the gaseous from the liquid ammonia and applying one or both of these streams to uses such as a fertilizer for the soil or as NPN for forage. The capacity of a single 4-inch expansion chamber has, for example, been increased from 200 pounds per hour to 730 pounds per hour by utilizing various aspects of this invention. The examples show this in more detail. By properly controlling the entrance of the inlet stream of ammonia into the expansion chamber plus the size and position of the vertically elongated barrier means in the center of the horizontal planes of the expansion chamber is believed to reduce the "short circuiting" that occurred in the prior art process of U.S. Pat. No. 4,069,029. This "short circuiting" is where a certain portion of the liquid droplets would go into the center of the chamber and then directly out the outlet for the gaseous ammonia without getting spun around and forced out the liquid outlet conduit at the bottom of the expansion chamber.

Due to the increased efficiency of liquid/vapor separation when practicing this invention it is possible to use expansion chambers of less weight, less volume and to eliminate the need for a separate complex mist eliminator. Also when more than one expansion chamber is used on a piece of field equipment, it is possible to utilize fewer such chambers for the same piece of equipment. These benefits result in a big savings in the cost of building an expansion chamber of a certain capacity. Preferably, the barrier means comprises a cylindrically shaped tube which also serves as the outlet for the gaseous ammonia and the top of this tube is near the top of the expansion chamber so that the gaseous ammonia is prevented from entering the tube except at or near the top of this tube. Preferably, the distance between the top of this tube and the top of the expansion is less than about 3 inches. The gaseous ammonia is then carried downward through the tube to the bottom of the expansion chamber where it exits from the chamber. This embodiment eliminates the crimping problem, mentioned previously, and provides a much more compact apparatus which is much more convenient for handling and attaching to other equipment.

This invention also includes a method and apparatus for treating soil, forage, etc. using the method and apparatus described above.

Figure 2:
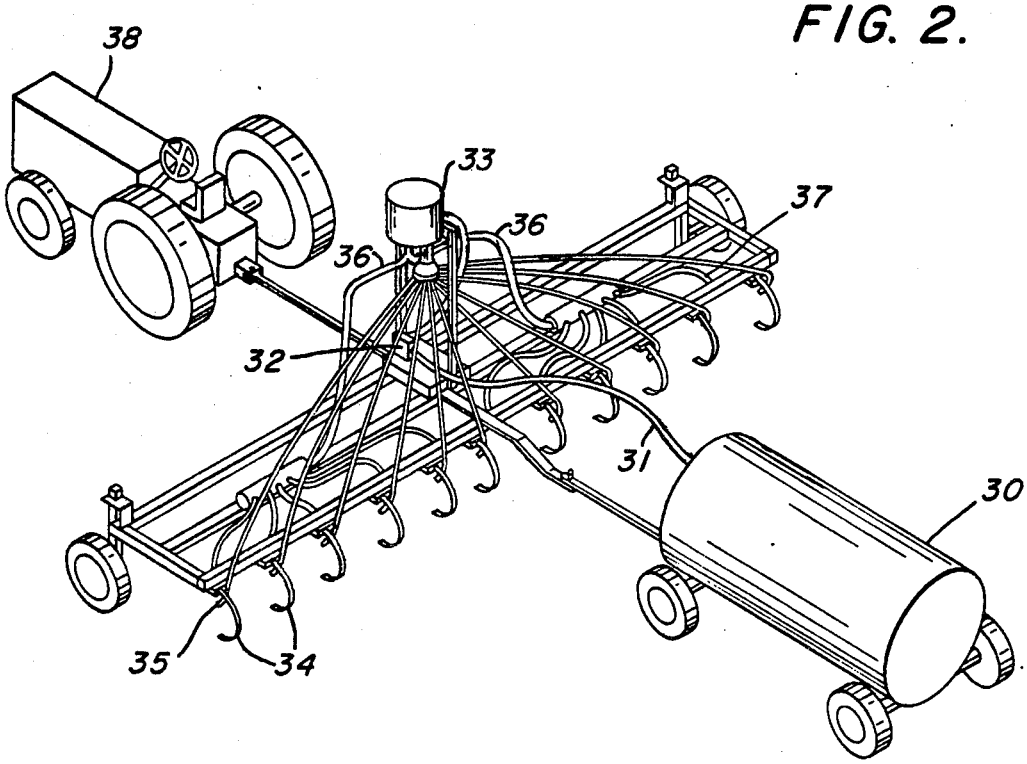

FIG. 1 schematically illustrates the practice of this invention in the embodiment wherein cold ammonia is applied directly to freshly cut forage material before loading in a truck and transportation for storage to produce silage;

FIG. 2 schematically illustrates another embodiment of the practice of this invention wherein cold anhydrous ammonia is applied for soil fertilization; and FIGS. 3, 4, 5, 6 and 7 schematically illustrate apparatus or structure in accordance with this invention for the expansion of a stream of pressurized, liquid, ambient temperature, ammonia into two separate streams of cold ammonia at substantially reduced pressure, one stream being cold gaseous ammonia and the other stream being cold liquid ammonia.

PREFERRED EMBODIMENT(S)

The ammonia useful in this invention is preferably anhydrous ammonia. However, the term includes ammonia containing other materials, preferably in minor amounts, such as water, insecticides, fungicides, nitrapyrin, plant nutrients or any other material that does not adversely affect the operation of the process. These other materials may be part of the ammonia in the pressurized tank of ammonia or may be added in the expansion chamber or at another suitable point in the process of this invention.

The expansion chamber of this invention may be of any suitable shape which will allow spinning flow to provide separation of the cold liquid ammonia from the cold gaseous ammonia in the chamber. Generally preferred is an axially elongated chamber more preferably a vertically elongated cylindrical chamber. Unless indicated to the contrary, it is intended that the term "expansion chamber" does not include the inlet conduit connecting the pressurized liquid ammonia vessel and the inlet of the expansion chamber. Generally, this inlet conduit will contain a control valve. Preferably, the inlet conduit enters the expansion chamber between about the mid-point of the vertical height and about one-fourth of the vertical height of the expansion chamber wall. Opening the control valve to cause the pressurized liquid ammonia to flow from the pressure tank to the main body of the expansion chamber will result in the ammonia in the feed line having a reduced pressure from that in the pressure tank. The pressure in the pressure container is generally between about 80 and about 200 psig, with 100–150 psig being most common. The pressure at the point in the feed line located at the inlet to the main body of the expansion chamber may vary depending upon the size of the inlet to the chamber, the ammonia flow rate in this line and like factors. However, the pressure at this point will generally be between about 5 and about 35 psig.

Preferably between about 10 and about 25 percent of the pressurized liquid ammonia entering the expansion chamber is converted to gaseous ammonia which cools the balance of the liquid ammonia in the chamber so that it remains in the liquid state at substantially ambient or atmospheric pressures.

The inlet stream of partially decompressed ammonia preferably enters the expansion chamber through an inlet conduit having a cross sectional area in the plane vertical to the direction of flow of the ammonia stream of between about 0.1 and about 0.3 square inches per 1000 pounds of ammonia per hour flow rate of ammonia through said conduit and more preferably wherein the barrier means has a vertical dimension equal to at least about four times the inside diameter of the inlet conduit at the point where the inlet conduit enters the expansion chamber.

The barrier means of this invention is preferably positioned so as to act as a barrier to at least the entire vertical width of the expansion cone of the inlet stream. The barrier means preferably has an average diameter of at least about one-fourth of the average diameter of the expansion chamber and preferably has a vertical dimension inside the chamber of at least about two-thirds of the vertical height of the chamber, and preferably wherein the vapor outlet is located at the top of the expansion chamber.

The partially decompressed ammonia stream is preferably introduced into the main body of the expansion chamber to provide tangential entry therein to impart a high velocity spinning motion to the ammonia stream entering the chamber so that rapid flow is produced in the interior of the chamber to thereby provide rapid separation of liquid and gaseous ammonia. The introduction velocity of the ammonia is at least 5,000 feet per minute and preferably has a velocity between about 10,000 and about 15,000 feet per minute. The flow rate of the ammonia stream entering the chamber is preferably about 100 and about 8000 pounds per hour. In applying ammonia to forage used for making silage flow rates between about 500 and about 2000 pounds per hour are common. A common rate of application to forage is about 6 to 8 pounds of ammonia per ton. For application of ammonia to the soil, where a single expansion chamber is utilized for a large field cultivator, a flow rate into the expansion chamber of between about 2000 and about 8000 pounds per hour is common. The amount of ammonia applied to the soil may vary according to the needs of the particular crop or the deficiency of the soil or other well known factors. About 200 pounds of ammonia per acre is a typical soil application rate. Side dressing rates may be much smaller, however.

The percentage of pressurized liquid ammonia converted to cold gaseous ammonia in the expansion chamber is generally between about 10 and about 25% and more typically between about 18 and about 22%. This percentage will vary depending upon the composition of the ammonia, the pressure in the chamber and on other factors known to the art.

The cold liquid ammonia in the main body of the expansion chamber is directed to the outlet at the bottom of the chamber. This is preferably accomplished by a barrier means such as a barrier strip with one end of the strip located at the bottom edge of the vertical chamber wall and the other end of the strip located at the outlet for the cold liquid ammonia.

Preferably, the barrier strip is a flat vertical strip which provides a smooth flow of cold liquid ammonia from the chamber wall to the outlet for the cold liquid ammonia. The means for directing the cold liquid ammonia to the outlet can be accomplished by other means such as by having a conical shaped expansion chamber such that the narrowest portion of the cone leads into the outlet for the cold liquid ammonia.

A mist eliminator for eliminating suspended droplets of liquid ammonia from the cold gaseous ammonia leaving the expansion chamber through the outlet for the cold gaseous ammonia may be used. A gauze type mist eliminator over the outlet for the gaseous ammonia is a preferred embodiment due to its simplicity and effectiveness.

The expansion chamber of this invention is provided with a distributor system comprising product lines generally in the form of tubes leading from the different outlets from the chamber. The size of the tube for the cold gaseous ammonia is selected such that the ammonia going into the soil, forage or other product can preferably flow without back pressure.

The distributor system for the cold liquid ambient or atmospheric pressure ammonia is not quite so critical but the flow must be regulated so that loss of liquid is avoided due to splashing etc. The inside diameter of distributor tubing useful for cold liquid ammonia may preferably be between ¼ inch and about 1 inch and the inside diameter of tubing for the cold gaseous ammonia may preferably be between about ¾ inch and about 2 inches.

The cold gaseous ammonia in one embodiment of this invention may be recycled to a compressor for the gaseous ammonia and reintroduced as a liquid to the pressurized liquid ammonia tank or any pressurized lines attached thereto. The field cultivator is defined herein to include any apparatus useful for cultivating the soil such as a harrow, disc, plow or any combination thereof.

The expansion chamber of this invention preferably has a weight of less than about 50 pounds and a volume of less than about 2 cubic feet. More preferably, the expansion chamber has a weight of less than about 25 pounds and a volume of between about 0.03 and about 1.5 cubic feet.

FIG. 1 of the drawings illustrates one embodiment of this invention wherein a mixture of cold gaseous anhydrous ammonia and cold liquid anhydrous ammonia at a temperature of about −28° F., is applied at substantially atmospheric pressure to freshly cut or harvested plant material suitable for silage production. As illustrated, conveyor body 10 carried on towed or self-propelled wheeled vehicle, generally indicated by reference numeral 11, is provided with an endless conveyor 12, such as a helical disc conveyor. Conveyor 12 serves to transport the plant material added to conveyor body 10 to blower 14 for discharge via chute 15 into truck 16 for transport to the silo for storage of the plant material for silage production.

The plant material put into conveyor body 10 has applied thereto cold, atmospheric pressure anhydrous ammonia in accordance with this invention. Ammonia is supplied from tank 18 carried on vehicle 11. Tank 18 contains pressurized liquid anhydrous ammonia at substantially ambient temperature, such as a temperature in the range 50°–100° F., more or less, depending upon the environment. Pressurized liquid ammonia leaves tank 18 through adjustable control valve 19 and conduit 20 and enters expansion chamber 21. The pressurized ambient temperature liquid anhydrous ammonia is supplied to and adiabatically expanded within expansion chamber 21 at a rate such that a major amount of the supplied pressurized ambient temperature liquid anhydrous ammonia is converted to a major amount of cold anhydrous liquid ammonia at substantially atmospheric pressure, with the remaining minor amount being converted to cold gaseous anhydrous ammonia.

The cold liquid anhydrous ammonia at substantially atmospheric pressure leaves expansion chamber 21 via outlet conduit 22 and the cold gaseous anhydrous ammonia at substantially atmospheric pressure leaves expansion chamber 21 via outlet conduit 24. The cold liquid anhydrous ammonia and the cold gaseous anhydrous ammonia issuing from expansion chamber 21 via outlet conduits 22 and 24, respectively, are discharged directly into contact with and/or applied directly onto the plant material being handled and conveyed within conveyor body 10 for discharge via blower 14 and chute 15 into truck 16.

FIG. 2 of the drawings illustrates the application of cold ammonia to the soil. The field cultivator 34, such as a disc, harrow, or plow, has attached thereto an expansion chamber 33 of the type described in this invention. Ammonia is supplied from pressure tank 30 through inlet conduit 31 to expansion chamber 33. The pressurized liquid ammonia leaves tank 30 through adjustable control valve 32 and the conduit 31 and enters expansion chamber 33. The inlet conduit 31 enters the expansion chamber 33 at an inlet 38 between about midway and one-fourth the distance up the vertical side of the expansion chamber. The pressurized liquid ammonia enters the expansion chamber 33 tangentially to the inside of the chamber to impart a high velocity spinning motion to the pressurized ammonia to thereby separate the gaseous and liquid ammonia in the expansion chamber 33. The cold liquid ammonia at substantially atmospheric or ambient pressure leaves the bottom of the expansion chamber through distributor conduits 32 which are spaced in such a manner that liquid ammonia is applied to the ground at substantially equal spacings in front of the blades of the field cultivator and this liquid ammonia is immediately covered by soil by the action of the field cultivator being moved across the field by the tractor 38. The liquid ammonia may be applied to the top of the soil or by shallow blades just below the surface of the soil. About 10 to about 25% of the pressurized liquid ammonia from the pressure tank is converted to gaseous ammonia in the inlet conduit 31 and the expansion chamber 33. This gaseous ammonia is delivered to the field through conduit 36 which is positioned on the cultivator such that the ends 37 are below the soil, preferably about 2 to 3 inches below the surface of the soil.

Figure 3:
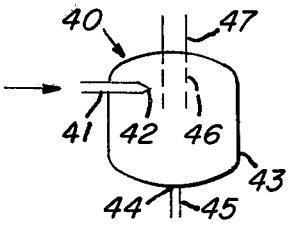

FIG. 3 of the drawings illustrates a schemmatic of one embodiment of an expansion chamber useful in this invention for the expansion and separation of partially decompressed liquid ammonia. The expansion chamber, generally indicated by reference number 40 comprises a closed chamber or container 43, which chamber is preferably axially elongated and more preferably in the form of a vertically elongated cylinder. Any shape for the expansion chamber is suitable so long as flow is produced which results in separation of cold gaseous ammonia from cold liquid ammonia. Inlet opening 42 has welded thereon inlet conduit 41. Inlet conduit 41 is preferably connected through opening 42 in such a manner that partially decompressed liquid ammonia passing through opening 42 into closed container 43 enters in a tangential direction in order to impart high velocity spinning motion to the liquid ammonia in the chamber such that rapid flow is produced around the interior circumference of the chamber to thereby provide rapid separation of the liquid and gaseous ammonia in the chamber. A vertically elongated barrier means 46 in the form of a hollow tube in the center of the horizontal planes of the expansion chamber extends from almost midway in the expansion chamber 43 out the top of this chamber 43 to provide an exit for the gaseous ammonia to exit conduit 47. The inlet conduit enters the chamber 43 in the upper portion of the chamber wall such that the vertically elongated barrier means 46 is directly in the path of the expansion cone of the inlet stream of ammonia (except that the ammonia stream is directed tangentially around the inside of the expansion chamber 43). The liquid ammonia goes through exit opening 44 into exit conduit 45.

Figure 4:
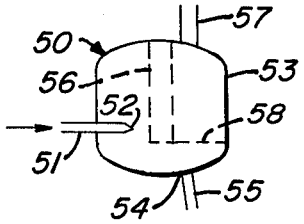
Figure 5:
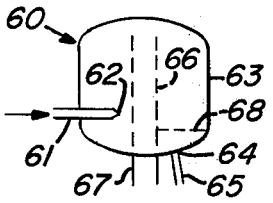

FIGS. 4–7 are variations of the FIG. 3 device, except that they relate to preferred embodiments of this invention wherein the inlet for the partially decompressed ammonia stream enters the side of the chamber wall below about the mid-point and one-fourth of the vertical height of such wall. Also the vertically elongated barrier means in the form of a center tube extends at least about two-thirds of the vertical height of the expansion chamber. The closed bottom end of the center tube of FIGS. 4–7 avoids re-entrainment of liquid ammonia droplets in the gaseous ammonia stream by eliminating the problem of the FIG. 3 expansion chamber whereby liquid droplets collecting on the center tube drip off the end of the center tube into the rapidly moving gaseous stream heading for the outlet conduit. In FIG. 4 the center tube 56 extends from the top of the expansion chamber 53 to almost the bottom of the expansion chamber 53. Barrier means 58 preferably in the form of a barrier strip, has one end of the barrier means 58 adjacent to the vertical wall of the chamber 53 and the other end near the outlet 54 for the cold liquid ammonia to assist in directing the cold liquid ammonia to exit conduit 55. The gaseous ammonia exits through the top of the chamber 53 through exit conduit 57. FIG. 5 is identical to FIG. 4 except that the center tube 66 is hollow and acts as the exit through the bottom of the chamber 63. The wall of center tube 66 is impervious to liquid ammonia which results in some of the liquid droplets striking this tube 66 and running to the bottom where it leaves the chamber through exit 64 into exit conduit 65. The gaseous ammonia rises to the top of the chamber where it enters the top of the center tube 66 which is located within about 3 inches from the top of the chamber 63.

Figure 6:
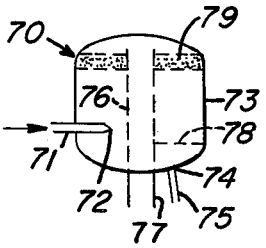

FIG. 6 is identical to FIG. 5 except that the expansion chamber 70 contains a gauze type mist eliminator 79 which separates liquid ammonia droplets from the gaseous ammonia.

Figure 7:
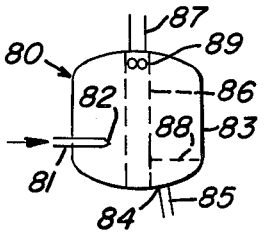

FIG. 7 is identical to FIG. 5 except the center tube 86 extends the full vertical height of the chamber 80 and has openings 89 in the tube wall to allow the gaseous ammonia to enter the tube 86 and then enter exit conduit 87.

The following examples illustrate this invention.

EXAMPLES 1-5

An expansion chamber of the dimensions given for Example 1 of the table below and the configuration shown in FIG. 3 except that center tube 46 is not hollow and extends from the top to almost the bottom of the chamber and has an outside diameter of only about ⅜ inch. Two horizontal baffles are arranged inside the chamber as taught in U.S. Pat. No. 3,978,681 such that one baffle is above the inlet stream and one baffle is below the inlet stream. Examples 2, 3 and 5 use expansion chambers in the form of FIG. 6 described above. Example 4 uses an expansion chamber substantially identical to that of Example 5 except that there is no center tube and an exit conduit is provided in the top of the chamber for the gaseous ammonia.

Example 1 shows that the ⅜ inch center tube does not act as a meaningful barrier means because of the small diameter. The baffles and the center tube in the expansion chamber of Example 1 have little or no effect in increasing the capacity of a similar chamber without baffles. Increasing the diameter of the inlet conduit from Example 2 to 3 almost doubles the capacity of the expansion chamber, an increase from 400 lbs./hr. to 730 lb./hr.

Examples 4 and 5 show how the capacity of an expansion chamber is increased from 1500 lb./hr. to 2500 lb./hr. where the only significant difference is that one expansion chamber has a center tube which acts as an effective barrier means and the other chamber has no barrier means.

Thus, these examples show the importance of an effective vertically elongated barrier means in the expansion chamber as well as an inlet stream of ammonia which has been allowed to expand adequately in the inlet tube.

TABLE

| Ex. No. | Chamber Diameter (in.) | Chamber Height (in.) | Center Column, Outside Diameter (in.) | Inlet Tube, Inside Diameter (in.) | Chamber Capacity (lb/hr) | Chamber Capacity (lb/hr/in$^3$) |
|---|---|---|---|---|---|---|
| 1 | 4 | 12 | .375 and with 2 horizontal baffles | 0.25 | 200 | 1.2 |
| 2 | 4 | 12 | 1.5 | 0.25 | 400 | 2.4 |
| 3 | 4 | 12 | 1.25 | 0.50 | 730 | 4.5 |
| 4 | 8 | 15 | Without | 1.0 | 1,500 | 2.0 |
| 5 | 8 | 12 | 2.5 | 1.0 | 2.500 | 4.2 |

The cold ammonia thus produced is then applied to the soil and to forage as described in FIGS. 1 and 2.

I claim:

1. A method for carrying out the substantially adiabatic expansion of a pressurized stream of ambient-temperature liquid ammonia to produce a stream of cold liquid ammonia at a reduced pressure and a stream of cold gaseous ammonia at a reduced pressure, which comprises (1) introducing at a velocity of at least about 5000 feet per minute an inlet stream of partially decompressed liquid ammonia tangentially into an expansion chamber, the expansion chamber comprising a substantially vertically elongated barrier means located (a) substantially in the center of the horizontal planes of the expansion chamber and (b) in the path of the expansion cone of the inlet stream, which barrier means assists in imparting a spinning motion to the inlet stream and allows some liquid ammonia to flow down the barrier means and thereby improves the separation of the liquid and gaseous ammonia, (2) imparting a high velocity spinning motion to the liquid ammonia entering the chamber such that rapid flow is produced around the interior of the chamber to thereby provide rapid separation of the liquid and gaseous ammonia in the chamber, and wherein the expansion chamber is provided with an outlet useful for the removal of gaseous ammonia therefrom which outlet is located above the paths of liquid flow to minimize the amount of liquid droplets being carried through the gaseous ammonia outlet and another outlet useful for the removal of cold liquid ammonia therefrom, the outlets being provided at opposite ends of the expansion chamber, (3) directing the flow of the cold reduced pressure liquid ammonia within the expansion chamber to the outlet useful for the withdrawal of cold reduced pressure liquid ammonia from the expansion chamber to effect separation between cold liquid ammonia and cold gaseous ammonia within the expansion chamber, and (4) withdrawing through the outlet useful for the removal of gaseous ammonia a stream of cold gaseous ammonia at reduced pressure and a stream of cold liquid ammonia at reduced pressure via the other outlet.

2. Method as in claim 1 wherein the inlet stream of partially decompressed ammonia enters the expansion chamber through an inlet conduit having a cross sectional area in the plane vertical to the direction of flow of the ammonia stream of between about 0.1 and about 0.3 square inches per 1000 pounds of ammonia per hour flow rate of ammonia through the conduit and wherein the barrier means has a vertical dimension equal to at least about four times the inside diameter of the inlet conduit at the point where the inlet conduit enters the expansion chamber.

3. Method as in claim 2 wherein the barrier means is positioned so as to act as a barrier to at least the entire vertical dimension of the expansion cone of the inlet stream.

4. Method as in claim 3 wherein the barrier means has an average diameter of at least about one-fourth of the average diameter of the expansion chamber and has a vertical dimension inside the chamber of at least about two-thirds of the vertical height of the chamber, and wherein the vapor outlet is located at the top of the expansion chamber.

5. Method of claim 4 wherein the stream of ammonia entering the expansion chamber enters at a flow rate of between about 100 and about 8000 pounds per hour.

6. Method as in claim 4 wherein the barrier means is cylindrically shaped.

7. Method as in claim 6 wherein the barrier means comprises a passageway for the gaseous ammonia.

8. Method as in claim 4 wherein the barrier means comprises a cylindrically shaped tube which also serves as the outlet for the gaseous ammonia.

9. Method as in claim 8 wherein the top of the tube is near the top of the expansion chamber and wherein the gaseous ammonia is prevented from entering the tube except at or near the top of this tube and is carried downward through the tube to the bottom of the expansion chamber where it exits from the chamber.

10. Method as in claim 4 wherein the expansion chamber is in the form of a vertically elongated cylinder and wherein the liquid ammonia is introduced through an opening between about the mid-point of the vertical height and about one-fourth of the vertical height on the cylinder wall.

11. Method as in claim 10 wherein the bottom of the expansion chamber contains a barrier strip to break the spinning motion and thereby facilitate the discharge of the liquid ammonia from the expansion chamber through the outlet for the cold liquid ammonia.

12. Method of claim 2 wherein the expansion chamber has a weight of less than about 50 pounds and the volume of the expansion chamber is less than about 2 cubic feet.

13. Method as in claim 12 wherein between about 10 and about 25 percent of the pressurized liquid ammonia entering the expansion chamber is converted to gaseous ammonia which cools the balance of the liquid ammonia in the chamber so that it remains in the liquid state at substantially ambient or atmospheric pressures and wherein the volume of the expansion chamber is between about 0.03 and about 1.5 cubic feet.

14. Method as in claim 2 additionally comprising (1) directing the cold gaseous ammonia stream which leaves the expansion chamber through a mist eliminator to thereby separate liquid ammonia droplets suspended in the gaseous stream, and (2) collecting the separated liquid ammonia from the gaseous stream and combining it with the cold liquid ammonia stream from the expansion chamber.

15. Method as in claim 14 wherein the mist eliminator comprises a gauze type mist eliminator.

16. Method as in claim 15 wherein the expansion chamber is in the form of a vertically elongated cylinder and wherein the high pressure liquid ammonia is introduced through a control valve in an inlet conduit which enters an opening between about the midpoint and about one-fourth of the vertical height of the cylinder wall.

17. A method for carrying out the substantially adiabatic expansion of a pressurized stream of ambient-temperature liquid ammonia to produce a stream of cold liquid ammonia at substantially ambient or atmospheric pressure and a stream of cold gaseous ammonia at substantially ambient or atmospheric pressure, which comprises (1) introducing a stream of ambient-temperature pressurized liquid ammonia into an inlet conduit of sufficient size to allow partial decompression of the ammonia stream to an ammonia stream velocity of at least about 5000 feet per minute and which is sufficiently expanded that upon entry into an expansion chamber that the substantially unidirectional flow of the ammonia stream is maintained, (2) introducing the ammonia stream from the inlet conduit into an expansion chamber comprising a substantially vertically elongated barrier means located substantially in the center of horizontal planes of the expansion chamber, and the barrier means extending at least the vertical dimension of the path of the expansion cone of the inlet stream at the line of intersection of the axis of the barrier means and the expansion cone, which barrier means is in the form of a hollow cylinder having a bottom impervious to entry of liquid ammonia into the cylinder and having a vertical dimension at least about two-thirds of the vertical dimension of the inside of the expansion chamber and which barrier means assists in imparting a spinning motion to the inlet ammonia stream and allows some liquid ammonia to flow down the outside of the cylinder and improves the separation of the liquid and gaseous ammonia, (3) imparting a high velocity spinning motion to the liquid ammonia entering the chamber such that rapid flow is produced around the interior of the chamber to thereby provide rapid separation of the liquid and gaseous ammonia in the chamber, and wherein the expansion chamber is provided with an outlet useful for the removal of gaseous ammonia therefrom which outlet is located above the paths of liquid flow to thereby significantly reduce the amount of liquid ammonia droplets that are carried through the gaseous ammonia outlet and another outlet useful for the removal of cold liquid ammonia therefrom, said outlets being provided at opposite ends of the expansion chamber, (4) directing the flow of the cold substantially ambient or atmospheric pressure liquid ammonia within the expansion chamber to the outlet useful for the withdrawal of cold ambient or atmospheric pressure liquid ammonia from the expansion chamber to effect separation between cold liquid ammonia and cold gaseous ammonia within the expansion chamber, and (5) withdrawing through the outlet useful for the removal of gaseous ammonia a stream of cold gaseous ammonia at substantially ambient or atmospheric pressure and a stream of cold liquid ammonia at substantially ambient or atmospheric pressure via the other outlet.

18. Method as in claim 17 wherein the inlet conduit through which the pressurized ammonia enters the expansion chamber has a cross sectional area in the plane vertical to the direction of flow of the ammonia stream of between about 0.1 and about 0.3 square inches per 1000 pounds of ammonia per hour flow rate of ammonia through said conduit.

19. Method as in claim 18 wherein the barrier means has a diameter of at least about one-fourth of the diameter of the expansion chamber.

20. Method as in claim 19 wherein the top of the hollow cylinder is near the top of the expansion chamber and wherein the gaseous ammonia is prevented from entering the cylinder except at or near the top of this cylinder and is carried downward through the cylinder to the bottom of the expansion chamber where it exits from the chamber.

21. Method as in claim 20 wherein the expansion chamber is in the form of a vertically elongated cylinder and wherein the liquid ammonia is introduced through an opening between about the mid-point of the vertical height and about one-fourth of the vertical height on the cylinder wall.

22. Method as in claim 21 additionally comprising (1) directing the cold gaseous ammonia stream which leaves the expansion chamber through a mist eliminator to thereby separate any remaining liquid ammonia droplets suspended in the gaseous stream, and (2) collecting the separated liquid ammonia from the gaseous stream and combining it with the cold liquid ammonia stream from the expansion chamber.

23. Method as in claim 22 wherein the mist eliminator comprises a gauze type mist eliminator.

24. An apparatus for carrying out the substantially adiabatic expansion of a pressurized stream of ambient-temperature liquid ammonia to produce a stream of cold liquid ammonia at a reduced pressure and a stream of cold gaseous ammonia at a reduced pressure, which comprises (1) means for introducing at a velocity of at least about 5000 feet per minute an inlet stream of partially decompressed liquid ammonia tangentially into an expansion chamber, (2) the expansion chamber comprising a substantially vertically elongated barrier means located (a) substantially in the center of the horizontal planes of the expansion chamber and (b) in the path of the expansion cone of the inlet stream, which barrier means assists in imparting a spinning motion to the inlet stream and allows some liquid ammonia to flow down the barrier means and thereby improves the separation of the liquid and gaseous ammonia, (3) means for imparting a high velocity spinning motion to the liquid ammonia entering the expansion chamber such that rapid flow is produced around the interior of the expansion chamber to thereby provide rapid separation of the liquid and gaseous ammonia in the expansion chamber, and wherein the expansion chamber is provided with (4) an outlet for removing the gaseous ammonia therefrom which outlet is located above the paths of liquid flow to minimize the amount of liquid droplets being carried through the gaseous ammonia outlet, (5) another outlet useful for the removal of cold liquid ammonia from the expansion chamber, the outlets being provided at opposite ends of the expansion chamber, (6) means for directing the flow of the cold reduced pressure liquid ammonia within said expansion chamber to the outlet useful for the withdrawal of cold reduced pressure liquid ammonia from the expansion chamber to effect separation between cold liquid ammonia and cold gaseous ammonia within the expansion chamber, (7) means for withdrawing through the outlet useful for the removal of gaseous ammonia a stream of cold gaseous ammonia at reduced pressure, and (8) means for withdrawing a stream of cold liquid ammonia at reduced pressure via the other outlet.

25. Apparatus as in claim 24 wherein the inlet stream of partially decompressed ammonia enters the expansion chamber through an inlet conduit having a cross sectional area in the plane vertical to the direction of flow of the ammonia stream of between about 0.1 and about 0.3 square inches per 1000 pounds of ammonia per hour flow rate of ammonia through said conduit and wherein the barrier means has a vertical dimension equal to at least about four times the inside diameter of the inlet conduit at the point where the inlet conduit enters the expansion chamber.

26. Apparatus as in claim 25 wherein the barrier means is positioned so as to act as a barrier to at least the entire vertical dimension of the expansion cone of the inlet stream.

27. Apparatus as in claim 26 wherein the barrier means has an average diameter of at least about one-fourth of the average diameter of the expansion chamber and has a vertical dimension inside the chamber of at least about two-thirds of the vertical height of the chamber, and wherein the vapor outlet is located at the top of the expansion chamber.

28. Apparatus as in claim 27 wherein the barrier means is cylindrically shaped.

29. Apparatus as in claim 27 wherein the barrier means comprises a cylindrically shaped tube which also serves as the outlet for the gaseous ammonia.

30. Apparatus as in claim 29 wherein the top of the tube is near the top of the expansion chamber and wherein the tube is impervious to the entrance of gaseous ammonia except at or near the top of this tube, wherein the tube for carrying the gaseous ammonia downward through the tube to the bottom of the expansion chamber where it connects with exit means for transporting the gaseous ammonia from the chamber.

31. Apparatus as in claim 27 wherein the expansion chamber is in the form of a vertically elongated cylinder and wherein means for introducing the partially decompressed liquid ammonia comprises an inlet opening between about the mid-point of the vertical height and about one-fourth of the vertical height on the cylinder wall.

32. Apparatus as in claim 31 wherein the bottom of the expansion chamber contains a barrier strip to break the spinning motion and thereby facilitate the discharge of the liquid ammonia from the expansion chamber through the outlet for the cold liquid ammonia.

33. Apparatus of claim 25 wherein the expansion chamber has a weight of less than about 50 pounds and wherein the volume of the expansion chamber is less than about 2 cubic feet.

34. Apparatus of claim 33 wherein the expansion chamber provides means for converting between about 10 and about 25 percent of the pressurized liquid ammonia entering the expansion chamber to gaseous ammonia which cools the balance of the liquid ammonia in the chamber so that it remains in the liquid state at substantially ambient or atmospheric pressures, and wherein the volume of the expansion chamber is between about 0.03 and about 1.5 cubic feet.

35. Apparatus as in claim 25 additionally comprising (1) means for directing the cold gaseous ammonia stream which leaves the expansion chamber through a mist eliminator, (2) a mist eliminator for separating liquid ammonia droplets suspended in the gaseous stream, and (3) means for collecting the separated liquid ammonia from the gaseous stream.

36. Apparatus as in claim 35 wherein the mist eliminator comprises a gauze type mist eliminator.

37. Apparatus as in claim 3 wherein the expansion chamber is in the form of a vertically elongated cylinder and wherein the means for introducing the partially decompressed liquid ammonia to the expansion chamber comprises a control valve in an inlet conduit and wherein this inlet conduit comprises an inlet opening between about the mid-point and about one-fourth of the vertical height of the cylinder wall.

38. An apparatus for carrying out the substantially adiabatic expansion of a pressurized stream of ambient-temperature liquid ammonia to produce a stream of cold liquid ammonia at aub-stantially ambient or atmospheric pressure and a stream of cold gaseous ammonia at substantially ambient or atmospheric pressure, which comprises (1) means for introducing a stream of ambient-temperature pressurized liquid ammonia into an inlet conduit at an ammonia stream velocity of at least about 5000 feet per minute, (2) the inlet conduit of sufficient size to allow partial decompression of the ammonia stream in order that the ammonia stream is sufficiently expanded that upon entry into an expansion chamber that the substantially unidirectional flow of the ammonia stream is maintained, (3) the expansion chamber comprising a substantially vertically elongated barrier means, (4) the barrier means being located substantially in the center of horizontal planes of the expansion chamber, and the barrier means extending at least the vertical dimension of the path of the expansion cone of the inlet stream at the line of intersection of the axis of the barrier means and the expansion cone, which barrier means is in the form of a hollow cylinder having a bottom inpervious to entry of liquid ammonia into the cylinder and having a vertical dimension at least about two-thirds of the vertical dimension of the inside of the expansion chamber and which barrier means assists in imparting a spinning motion to the inlet ammonia stream and allows some liquid ammonia to flow down the outside of the cylinder and improves the separation of the liquid and gaseous ammonia, (5) means for imparting a high velocity spinning motion to the liquid ammonia entering the chamber such that rapid flow is produced around the interior of the chamber to thereby provide rapid separation of the liquid and gaseous ammonia in the chamber, and wherein the expansion chamber is provided with (6) an outlet useful for the removal of gaseous ammonia therefrom which outlet is located above the paths of liquid flow to thereby significantly reduce the amount of liquid ammonia droplets that are carried through the gaseous ammonia outlet, and (7) another outlet useful for the removal of cold liquid ammonia therefrom, said outlets being provided at opposite ends of said expansion chamber, (8) means for directing the flow of the cold substantially ambient or atmospheric pressure liquid ammonia from the expansion chamber to effect separation between cold liquid ammonia and cold gaseous ammonia within the expansion chamber, (9) means for withdrawing through the outlet useful for the removal of gaseous ammonia a stream of cold gaseous ammonia at substantially ambient or atmospheric pressure, and (10) means for withdrawing a stream of cold liquid ammonia at substantially ambient or atmospheric pressure via the other outlet.

39. Apparatus as in claim 38 wherein the inlet conduit through which the pressurized ammonia enters the expansion chamber has a cross sectional area in the plane vertical to the direction of flow of the ammonia stream of between about 0.1 and about 0.3 square inches per 1000 pounds of ammonia per hour flow rate of ammonia through said conduit.

40. Apparatus as in claim 39 wherein the barrier means has a diameter of at least about one-fourth of the diameter of the expansion chamber.

41. Apparatus as in claim 40 wherein the top of the hollow cylinder is near the top of the expansion chamber and wherein the gaseous ammonia is prevented from entering the cylinder except at or near the top of this cylinder and is carried downward through the cylinder to the bottom of the expansion chamber where it exits from the chamber.

42. Apparatus as in claim 41 wherein the expansion chamber is in the form of a vertically elongated cylinder and wherein the liquid ammonia is introduced through an opening between about the mid-point of the vertical height and about one-fourth of the vertical height on the cylinder wall.

* * * * *

UNITED STATES PATENT AND TRADEMARK OFFICE

CERTIFICATE OF CORRECTION

PATENT NO. : 4,175,394

DATED : November 27, 1979

INVENTOR(S) : Robert A. Wiesboeck

It is certified that error appears in the above-identified patent and that said Letters Patent are hereby corrected as shown below:

Column 14, line 57, Claim 37, "3" should be -- 36 --.

Signed and Sealed this

*First* Day of *July 1980*

[SEAL]

*Attest:*

SIDNEY A. DIAMOND

*Attesting Officer*

*Commissioner of Patents and Trademarks*